US005701609A

United States Patent [19]

Bridges

[11] Patent Number: 5,701,609

[45] Date of Patent: Dec. 30, 1997

[54] PROTECTIVE DRAPE FOR HARD HATS AND THE LIKE

[76] Inventor: Karin Hoherchak Bridges, 1611 Vinings Pkwy., Smyrna, Ga. 30080

[21] Appl. No.: 529,367

[22] Filed: Sep. 18, 1995

[51] Int. Cl.[6] ..... A42B 3/04

[52] U.S. Cl. ..... 2/422; 2/172

[58] Field of Search ..... 2/172, 181.4, 181.2, 2/181, 184.5, 5, 209.11, 209.13, 208, 202, 205, 203, DIG. 11, 422, 410

[56] References Cited

U.S. PATENT DOCUMENTS

| | | | |
|---|---|---|---|
| 350,398 | 10/1886 | Shunk . | |
| 1,492,577 | 5/1924 | Obermeyer . | |
| 2,184,043 | 12/1939 | Heilstedt et al. . | |
| 2,822,546 | 2/1958 | Barker, Jr. . | |
| 3,156,921 | 11/1964 | Dye | 2/416 |
| 3,205,508 | 9/1965 | Cox . | |
| 3,594,814 | 7/1971 | Schuessler . | |
| 3,758,889 | 9/1973 | Erb | 2/416 |
| 3,825,952 | 7/1974 | Pershing et al. . | |
| 4,031,567 | 6/1977 | Planck . | |
| 4,272,853 | 6/1981 | Schuessler . | |
| 4,887,319 | 12/1989 | Daniels . | |
| 4,975,980 | 12/1990 | Ersteniuk . | |
| 4,993,081 | 2/1991 | Fulghum . | |
| 5,022,095 | 6/1991 | Fleury . | |
| 5,048,128 | 9/1991 | Watson, Jr. . | |
| 5,062,163 | 11/1991 | Avey . | |
| 5,083,317 | 1/1992 | DeMoreta . | |
| 5,088,126 | 2/1992 | Mathis . | |
| 5,105,476 | 4/1992 | Cox . | |
| 5,153,943 | 10/1992 | Clement . | |
| 5,265,279 | 11/1993 | Mathis . | |
| 5,323,491 | 6/1994 | Barrett, Jr. . | |
| 5,355,535 | 10/1994 | Bruder . | |
| 5,517,691 | 5/1996 | Blake | 2/414 |

OTHER PUBLICATIONS

Catalog pages from E.D. Bullard Company "Head Protection Products" catalog showing items CSS (cotton sun shade) and SS28 (acetate sun shade).

Photos of E.D. Bullard Company cotton sun shade and acetate sun shade.

*Primary Examiner*—C. D. Crowder
*Assistant Examiner*—Larry Worrell, Jr.
*Attorney, Agent, or Firm*—Sanford J. Asman

[57] ABSTRACT

A substantially rectangular, protective drape which is selectively attachable to a hard hat, preferably includes a strip of "hook and loop" fastener along one edge. A complementary strip of "hook and loop" fastening material is attached to the inner wall of the hard hat. The drape is used to protect the neck and, selectively, the ears, of the user from the elements.

9 Claims, 4 Drawing Sheets

PROTECTIVE DRAPE FOR HARD HATS AND THE LIKE

BACKGROUND OF THE INVENTION

The present invention relates to an article of protective headgear of the type worn by persons whose work requires them to spend time a good deal of time outdoors or in environments which have a great deal of airborne contaminants, such as coal fired power generating plants, mines, or construction sites. In particular, the present invention relates to a removable drape which is readily attached to (and detached from) articles of headgear, such as hard hats.

As is well known by those whose work involves a substantial amount of time outdoors or in dangerous locations, protective headgear is often worn. As used herein, the term "hard hat" is intended to be representative of such protective headgear, but the term is not intended to be limited solely to the type of hard hat which is worn by those in the construction and repair trades. Also, while the term "work" is used herein, such term is intended to include recreation, or other outdoor activity. Accordingly, any type of headgear which has a hard, protective outer shell, which is spaced from the wearer's head, i.e., by an internal web or by foam rubber or styrofoam pads, is intended to be included within the scope of the present invention. Thus, a sports type hat, such as a batting helmet, a bicycle helmet, or a motorcycle helmet, would be a suitable "hard hat" for use with the present invention.

While protective headgear of the type referred to herein is traditionally designed to prevent injury to the head of the wearer, such headgear is not necessarily also designed to prevent discomfort, of the type caused by the elements (i.e., the sun, rain, or cold) or by airborne particles (i.e., coal dust), to the wearer.

Consequently, it is a common experience, to those who spend a lot of time outdoors, to have the back of their neck exposed to the elements (i.e., sun, rain, or cold). Similarly, the back of the necks of coal (or other) miners, or others who work in the presence of airborne particles, is exposed to airborne contaminants. As the typical hard hat covers only the wearer's head, and not the back of the wearer's neck, it would be desirable to provide some form of protection against the elements to the wearer. However, as such protection would not always be needed, and even when needed, it would not always be needed for the same type of situation, it would be desirable if such additional protection could be readily and selectively added to, or removed from, the protective headgear. Also, it would be desirable if different types of protective drapes could be used to protect, respectively, against different types of elements, i.e., a different material, or a different length, or a different width, might be used to protect against different conditions (sun, rain, cold, airborne contaminants, etc.).

REFERENCES TO PRIOR ART

The problems discussed above have been the subject of numerous patents which have attempted to solve the problems set forth herein, but which have not successfully done so. The most relevant art known is described in the following patents, whose primary differences from the present invention is briefly described:

(a) U.S. Pat. No. 350,398 entitled HAT COVER AND NECK SHIELD which issued on Oct. 5, 1886 B. Shunk describes a protective cover for top hat which includes an asbestos lined drape. The protective cover fits over the entire hat and its brim. Unlike the present invention, the protective cover does not fit within the hat, and it is not used with a hard hat having an inner suspension.

(b) U.S. Pat. No. 1,492,577 entitled FIREMAN'S HELMET AND TEE LIKE which issued on May 6, 1924 to F. Obermeyer describes a fireman's helmet having a head apron. Unlike the present invention, the head apron is specifically adapted to a particular design of a fireman's helmet. Further, it does not include a drape of the type used with the present invention. Finally, unlike the present invention, the head apron is specifically intended to contact the wearer's head.

(c) U.S. Pat. No. 2,184,043 entitled SAFETY HELMET which issued on Dec. 19, 1939 to H. R. Heilstedt, et al. describes a safety helmet having a cap insert. Unlike the present invention, the cap insert is adapted to the particular helmet, and it does not include a neck protecting drape. Further, it appears to be adapted for specific use with the helmet described.

(d) U.S. Pat. No. 2,822,546 entitled SUSPENSION DEVICE FOR HELMETS which issued on Feb. 11, 1958 to L. P. Barker, Jr. describes a helmet with a suspension system having an adjustable sized headband for ease of adjustment to the head size of different wearers. The patent describes the attachment of a cape to the helmet by means of an attachment strip 26 which is specifically designed for use with the suspension system of the helmet which must be of the type wherein the understructure is attached to the helmet by means of snap fasteners. Unlike the present invention, the cape cannot be readily fitted to helmets having suspension systems which are different (or which are attached in a different manner) from the one described in that patent. Further, because of the design of the attachment strip, it appears that it would be relatively expensive to manufacture the drapes, as the specific attachment strip used for specific helmets would have to be used in each instance. Also, the attachment strip does not attach the cape directly to the inner wall of the helmet, but rather hangs between the wall of the helmet and the sweat band. Such construction brings the cape significantly closer to the wearer's head than does the present invention.

(e) U.S. Pat. No. 3,205,508 entitled SAFETY HELMET LINER AND ASSEMBLY which issued on Sep. 14, 1965 to W. W. Cox describes a cold weather liner for a safety hat. The liner fits between the hat's outer shell and the harness which fits the hat to the wearer's head. Consequently, the liner has a design which specifically fits each model hard hat with which it is to be used. Unlike the present invention, it is not a drape; it includes a spring mechanism (41) which encircles the wearer's neck; it cannot be readily fitted to any hard hat design, and the liner is connected to the head suspension assembly, rather than to the inner wall of the helmet.

(f) U.S. Pat. No. 3,594,814 entitled SAFETY HAT LINER AND ASSEMBLY which issued on Jul. 27, 1971 to W. E. Schuessler describes a liner for a hard hat which fits between the hat's outer shell and the harness which fits the hat to the wearer's head. The liner must be custom made for each model hard hat with which it is to be used, due to the design which would otherwise interfere with the attachment of the harness to the hard hat. Unlike the present invention, it is not a drape; it contacts the wearer's head; it encircles the wearer's neck; and it cannot be readily fitted to any hard hat design.

(g) U.S. Pat. No. 3,825,952 entitled SKIRTED HELMET which issued on Jul. 30, 1974 to R. L. Pershing, et al.

describes a skirt which is intended to encircle the neck of the wearer and to be worn within a helmet, i.e., a motorcycle helmet, which does not have any spacing means to separate the skirt from the wearer's head. Unlike the present invention, it is not a drape; it contacts the wearer's neck; it encircles the wearer's neck; and it will prevent airflow (which may be desirable and which the present invention permits).

(h) U.S. Pat. No. 4,031,567 entitled HEADDRESS which issued on Jun. 28, 1977 to J. S. Planck describes a headdress which is a head covering which includes a headband and a kerchief-like head covering for a woman. Unlike the present invention, it is not meant to be a drape which could be attached to the inside of a hard hat.

(i) U.S. Pat. No. 4,272,853 entitled COLD WEATHER HOOD FOR SAFETY HAT which issued on Jun. 16, 1981 to W. E. Schuessler describes a knitted hood which fits over a hard hat to provide cold weather protection to the wearer. Unlike the present invention, it is not a drape, and it does not attach to the inside of the hard hat.

(j) U.S. Pat. No. 4,887,319 entitled UNITARY CONTIGUOUS FACE AND NECK PROTECTOR ALL WEATHER COVER FOR HARD HEAD GEAR which issued on Dec. 19, 1989 to D. Daniels describes a single piece face and neck cover which fits over the outside of a hard hat and which covers the face of the user. Unlike the present invention, it does not attach to the inside of the hard hat.

(k) U.S. Pat. No. 4,975,980 entitled PROTECTIVE HELMET FOR FIREFIGHTERS which issued on Dec. 11, 1990 to S. R. Ersteniuk describes a liner for use with a fire helmet. Unlike the present invention, the liner is attached to the internal suspension of the fire helmet where it contacts the wearer's head.

(l) U.S. Pat. No. 4,993,081 entitled FLEXIBLE SUN SHIELD which issued on Feb. 19, 1991 to D. D. Fulghum describes a sun shield which can be attached to the outside of a hat, like a brim, rather than to the inside like the present invention. It does not include any type of drape.

(m) U.S. Pat. No. 5,022,095 entitled DISPOSABLE LINER FOR HARD HATS which issued on Jun. 11, 1991 to R. L. Fleury describes a disposable liner for use with a hard hat of the type used with the present invention. However, it does not include any type of drape, and, unlike the present invention, it is intended to contact the head of the wearer.

(n) U.S. Pat. No. 5,048,128 entitled PROTECTIVE HEADWEAR which issued on Sep. 17, 1991 to J. C. Watson, Jr. describes an article of headwear. Unlike the present invention, it is not intended to be used with a hard hat, and there is no means for connecting it to a hard hat.

(o) U.S. Pat. No. 5,062,163 entitled HEAD PROTECTOR FOR USE WITH HARD HEAD GEAR which issued on Nov. 5, 1991 to I. D. Jean Avey describes a hood which fits over a piece of headgear. The hood is attached to the outside of the headgear, rather than to the inside, as in the present invention.

(p) U.S. Pat. No. 5,083,317 entitled SUN SCREEN HAT which issued on Jan. 28, 1992 to D. F. DeMoreta describes a sun screen hat which is a single piece which fits over the head of the wearer. There is no separate, detachable drape. There is no hard hat, and there is no attachment or retaining means of the type used with the present invention.

(q) U.S. Pat. No. 5,088,126 entitled DISPOSABLE LINER FOR PROTECTIVE HEAD COVERINGS which issued on Feb. 18, 1992 to R. M. Mathis describes a sweat band which is used to line the front of the inside of a hard hat of the type used with the present invention. However, it does not include any type of drape.

(r) U.S. Pat. No. 5,105,476 entitled SPORTS VISOR WITH SWEAT BAND AND REMOVAL VISOR which issued on Apr. 21, 1992 to C. J. Cox describes a sports visor of the type which includes an adjustable sweat band. A drape may be attached to the sweat band. Unlike the present invention, there is no hard hat, and the drape is not spaced from the head of the wearer.

(s) U.S. Pat. No. 5,153,943 entitled WEATHER-SHIELD HAT ACCESSORY which issued on Oct. 13, 1992 to K. H. Clement describes a drape which may be attached to the adjustment straps at the rear of an adjustable baseball-style cap. Unlike the present invention, the shield cannot be fitted to a hard hat.

(t) U.S. Pat. No. 5,265,279 entitled LINER FOR PROTECTIVE HEAD COVERINGS which issued on Nov. 30, 1993 to R. M. Mathis describes a sweat band which is used to line the inside of a hard hat of the type used with the present invention. However, it does not include any type of drape.

(u) U.S. Pat. No. 5,323,491 entitled HEADGEAR FOR SHIELDING EARS AND NECK FROM ULTRAVIOLET RAYS which issued on Jun. 28, 1994 to C. R. Barrett, Jr. describes an article of headwear consisting of a sweatband with an integrated sun shield. Unlike the present invention, it is not intended to be used with a hard hat, and there is no means for connecting it to a hard hat.

(v) U.S. Pat. No. 5,355,535 entitled HAT SUNGUARD DEVICE which issued on Oct. 18, 1994 to T. A. Bruder describes a drape which is specifically shaped for attachment to a cap of the type which includes an inner band and an adjustable rear strap made up of two coupling members. Unlike the present invention, the device is not intended for use with a hard hat, and contains no means for attachment to a hard hat. Further, the device contacts the wearer's head, so it can adversely affect both the fit and comfort of the hat. In addition, the device is used with a standard adjustable cap which also contains no means for attachment to the drape.

SUMMARY OF THE INVENTION

The present invention is a "cloth" drape for use with a hard hat of the type which includes a hard outer shell which has an inner wall which is spaced from the head of the wearer. In accordance with the invention, the drape includes attachment means which may be selectively retained by retaining means attached to the inner wall of the headgear, and spaced from the head of the wearer, as the spacing prevents the drape from touching the head the wearer and causing any irritation or discomfort.

While the term "cloth" is used herein, those skilled in the art will recognize that both natural and synthetic fiber cloth may be used. Similarly, either a paper (or other "disposable") or plastic (or other "waterproof") material could be used, as could any material on which advertising indicia could be readily imprinted.

The particular material which is used for the drape can be selected to prevent the sun from bearing down on the user's neck, to prevent rain from hitting the wearer's neck, or to help protect the user's neck from the cold or from airborne contaminants (i.e., dust, dirt, grit, or manufacturing debris).

Further, by suitable selection of the drape material, a material which is readily imprinted may be used, i.e., for decorative purposes, company or team logos, or advertising indicia. In view of the low cost of the material of the drape, drapes which have been imprinted with advertising indicia for goods or services could be given away as promotional items. Similarly, team or company logos could be imprinted on such drapes, or decorative imprints could be placed upon such drapes.

DETAILED DESCRIPTION OF THE PREFERRED EMBODIMENT

Figure 1:
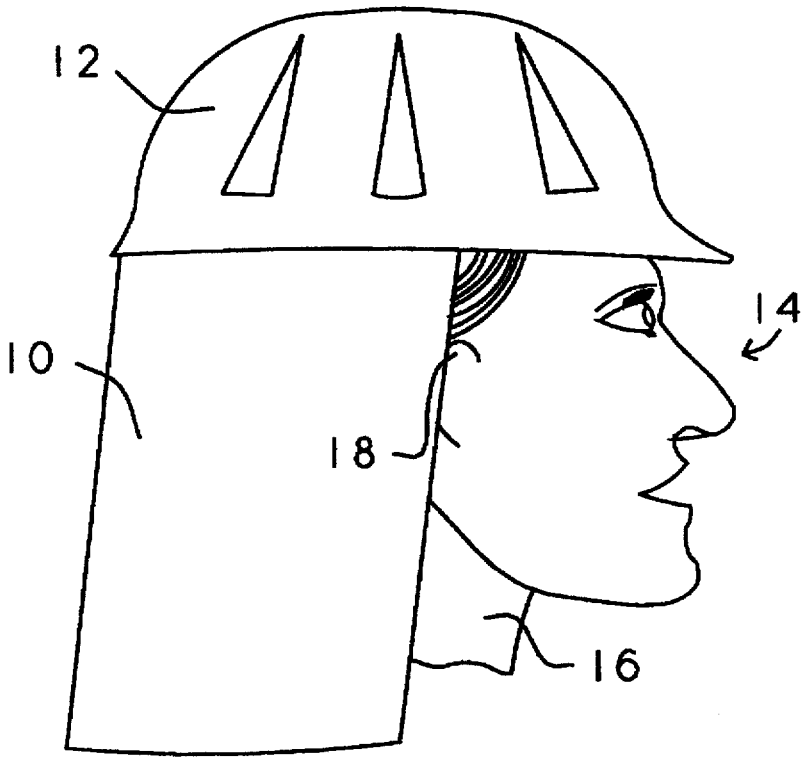
FIG. 1 is a side view of the present invention attached to a typical hard hat, showing how the hat and attached drape of the present invention appears in use.

Referring to FIG. 1, the present invention is a drape 10 which is selectively attached to a hard hat 12 of the type typically worn by a worker 14, i.e., one who might be employed in the construction or other trade which requires him to spend a considerable amount of time outdoors, or in dangerous or dirty environments. As described above, numerous other types of headgear which share similar configurations could be used with the present invention. These include sports type helmets which have a hard outer shell (i.e., motorcycle helmets, bicycle helmets, or batting helmets). However, hereinafter, herein the term "hard hat" will be described with reference to the protective type hat 12, although those skilled in the art will understand that the use of that term is not intended to be limiting.

The hard hat 12 is designed to be a protective piece of headgear, which can prevent head injuries to the wearer 14. However, those individuals who work outdoors (or in dangerous locations) typically have the backs of their necks and their ears exposed to the elements. Consequently, on sunny days, their necks and ears, can become painfully sunburned, while on rainy days, they are exposed to the rain. Accordingly, notwithstanding the intent of the hard hat to prevent injury to the wearer's head, they are not effective to prevent discomfort caused by the elements or by airborne particles.

The drape 10 of the present invention, however, is readily attached to a hard hat 12, and can readily accomplish the desired result of preventing discomfort caused by the elements. As illustrated in FIG. 1, the drape 10 preferably covers the back of the neck 16 of the wearer 14, and may selectively be sized (width and length) to also cover the ears 18 to afford them protection, as well.

Figure 2:
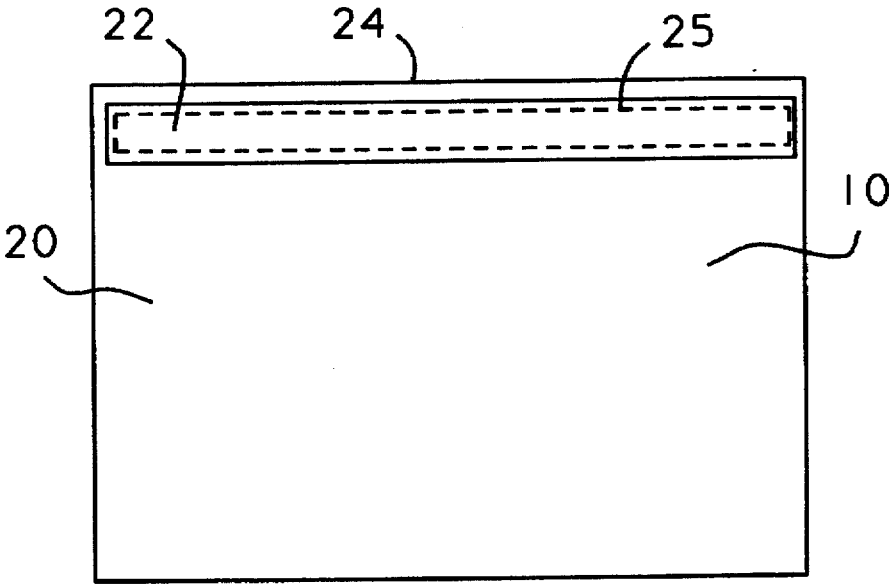
FIG. 2 is a top view of the drape of the preferred embodiment of the drape of the present invention detached from the hard hat of FIG. 1.

Referring to FIG. 2, the drape 10 is shown to be comprised of a suitable material, such as a piece of cloth 20. The cloth 20 may be selected to provide any one or more of several qualities consistent with the application, and, as a result of the ease with which the drape 10 may be selectively attached or detached from the hard hat 12, a plurality of interchangeable, replaceable drapes 10 may be provided to the wearer 14. For example, a light weight porous cloth might be used on hot, sunny days, while a thicker, relatively dense fabric might be used on cold, wintery days. Alternatively, a waterproof (or water resistant) material might be used in rainy weather. As a result of the utility of the present invention, and its relatively low cost, a material which is easily printed on may be used to provide either aesthetic designs or advertising.

Notwithstanding the particular material of which the drape 10 is made, it will be referred to herein as a "cloth". With continued reference to FIG. 2, the cloth drape 10 is preferably substantially rectangular in shape, although other shapes may be used without departing from the spirit or scope of the present invention.

An attachment means 22 is preferably attached adjacent to one edge 24 of the drape 10, as shown. While those skilled in the art will recognize that a variety of attachment means 22 can be used to attach the drape 10 to the hard hat 12, the preferred attachment means 22 is comprised of a strip 22 of hook and loop fastener material, of the type which is typically sold under the trademark "VELCRO". While it does not matter to the invention whether the "hook" material or the "loop" material is attached to the drape 10, some may consider it to be preferable to attach the "hook" material to the drape 10, as the complementary material, i.e., the "loop" material will be attached to the inside of the hat 12. As the drape 10 is removable from the hat 12, the presence of the "loop" material within the hat decreases the likelihood that the material will catch in the hair of the wearer 14. Alternatively, as the drape 10 may be laundered, and as the "hook" type material often picks up lint when laundered, it may be preferable to attach the "loop" material to the drape 10, and the "hook" material to the hat 12. As illustrated, the strip 22 is preferably attached to the drape 10 by means of conventional stitching 25 (assuming that the drape 10 is made of a woven or other compatible material).

Figure 3:
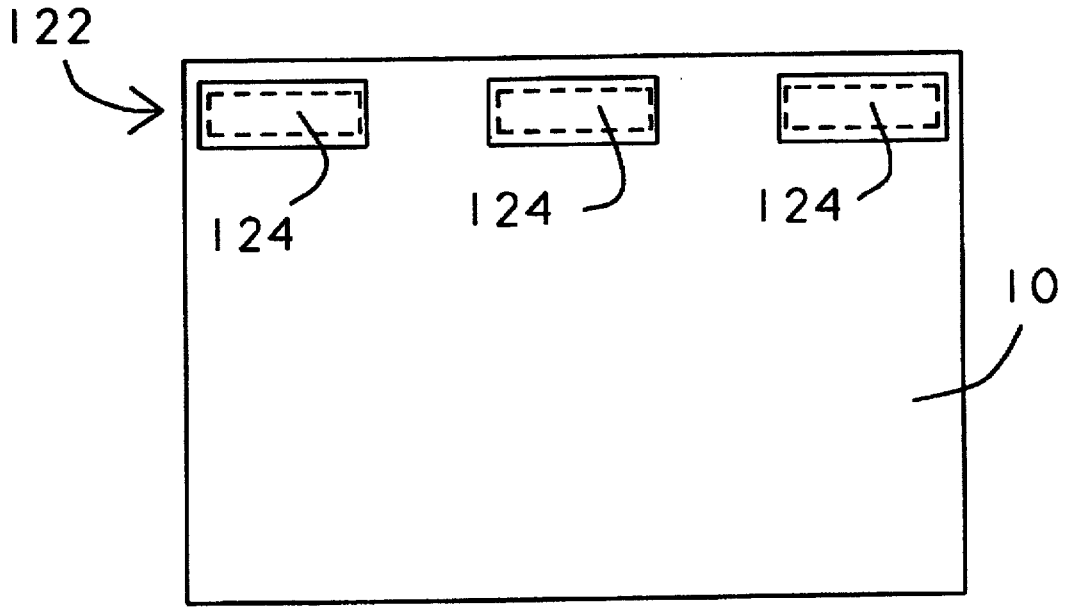
FIG. 3 is a top view of a first alternative embodiment of the drape of the present invention.
Figure 4:
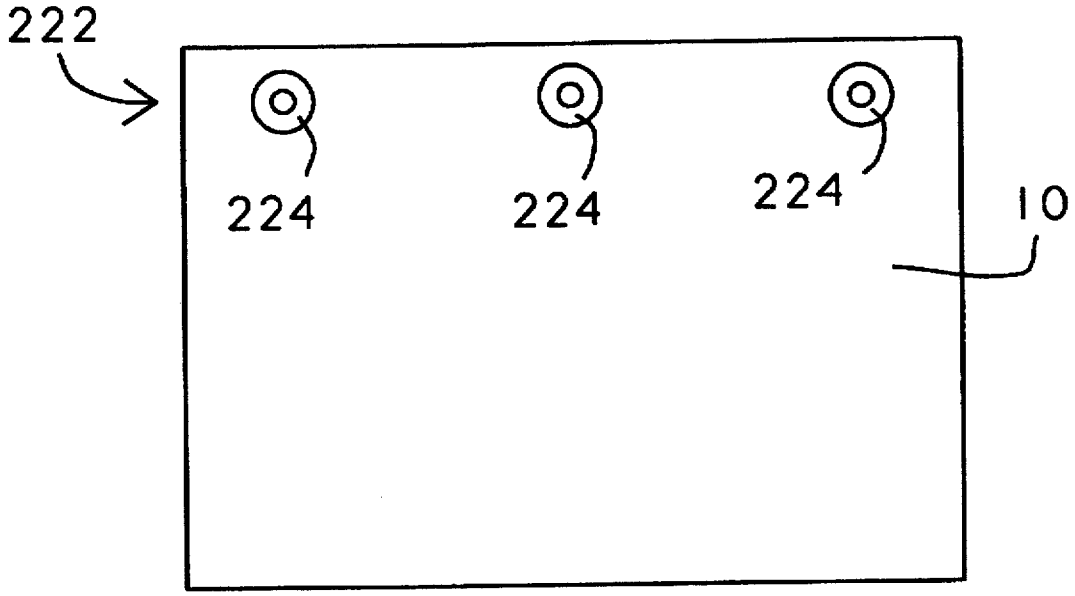
FIG. 4 is a top view of a second alternative embodiment of the drape of the present invention.

Those skilled in the art will recognize that in lieu of the single, elongated strip 22 shown in FIG. 2, other attachment means could be used. These include the attachment means 122, comprised of a number of smaller strips 124, as shown in FIG. 3, or the attachment means 222, comprised of a plurality of snaps 224, as shown in FIG. 4.

With particular reference to FIG. 2, in the case of the preferred hook and loop material attachment means 22, an elongated strip (of either the "hook" or the "loop" material) is affixed to the drape 10. In the preferred embodiment of the invention, the strip 22 is sewed to the drape 10, using conventional thread stitching 25. However, depending upon the material of which the drape 10 is made, it may be preferable to bond the strip 22 to the drape 10 material. For example, if a plastic material is used for the drape 10, then the strip 22 is preferably glued to the drape 10.

Figure 5:
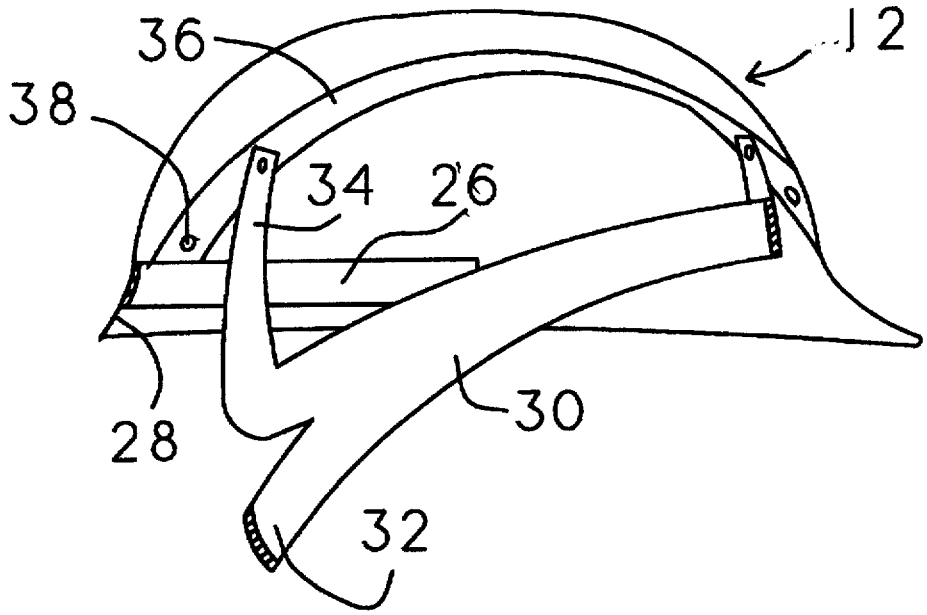
FIG. 5 is a cross-sectional side view of the hard hat of FIG. 1 showing the retaining means used to retain the drape of FIG. 2.

Referring now to FIG. 5, a cutaway view of the hard hat 12 of FIG. 1, with a retaining means 26 attached therein, is shown. The retaining means 26 is preferably comprised of the hook and loop retaining means which is the complementary material to the attachment means 22, i.e., if the attachment means 22 was of the "hook" type, then the retaining means 26 would be selected to be of the "loop" type. As illustrated, the retaining means 26 is affixed to the inner wall 28 of the hard hat 12, by bonding or by other suitable means. This is quite convenient, as hook and loop fasteners are commercially available with paper-backed adhesive backing material already applied, and that allows them to be stripped of the paper backing and pressed into place, which allows for the ready retrofit of existing hard hats, without any other structural modification.

The cross-sectional thickness of the retaining means is significantly more narrow than the space between the inner wall 28 and the understructure 30. Accordingly, when the additional thicknesses of the attachment means 22, and the drape 10 are in place, the entire assembly remains spaced from the wearer's head. Thus, when worn, the wearer's head (not shown) is retained by the adjustable understructure 30 of the hard hat 12, and the drape 10 is retained by the actual inner wall 28 of the hard hat 12, thereby spacing the drape 10 somewhat away from the understructure 30 (and, consequently, away from the wearer's head) to provide for ventilation and air flow adjacent to the wearer's head, thereby affording the wearer an additional modicum of comfort. Further, the spacing of the retaining means 26 from the wearer's head also prevents the retaining means 26 from causing any discomfort to the wearer either from the contact with the retaining means 26 or as a result to the alteration of the fit of the adjustable headband 32 of the understructure 30. As those skilled in the art will recognize, the headband 32 is typically attached to strips 34, which connect to support strips 36 which are actually attached to the wall of the hard hat 12, using rivets 38, or other suitable means (i.e., of the type illustrated in U.S. Pat. No. 5,088,126). Consequently, the retaining means 26, which is "outside" of the headband 32, is spaced from the wearer's head.

Figure 6:
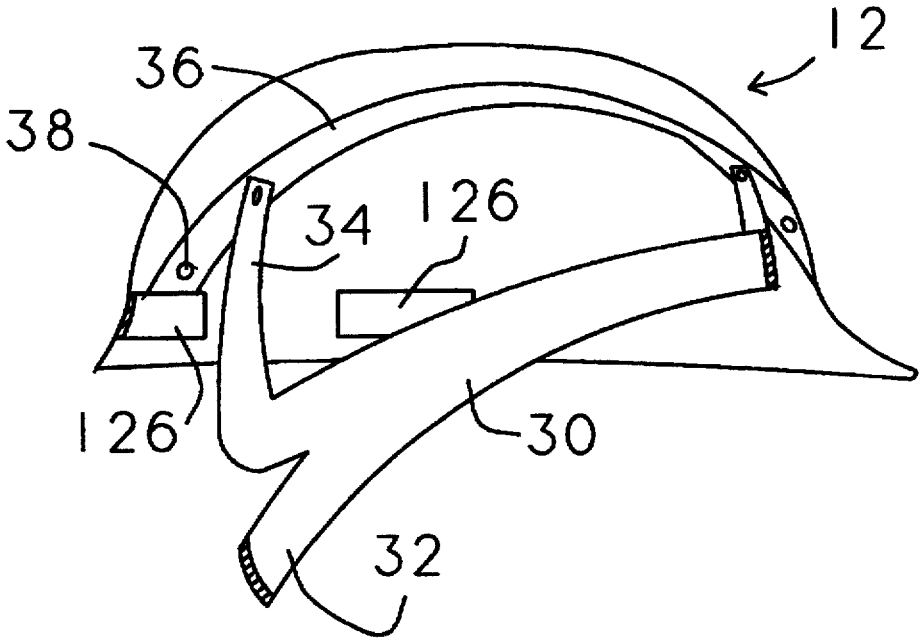
FIG. 6 is a cross-sectional side view of the hard hat of FIG. 1 showing the retaining means used to retain the drape of FIG. 3.

Referring to FIG. 6 an alternative embodiment of the hard hat 12, in which a retaining means 126 comprised of a plurality of hook and loop fasteners 126 is shown. The plurality of hook and loop fasteners 126 would be used with the attachment means 122 of FIG. 3, and would be of the complementary hook and loop material hook plurality of hook and loop fasteners, while illustrated as elongated strips, could also be of other suitable shapes, i.e., circles, without departing from the invention.

Figure 7:
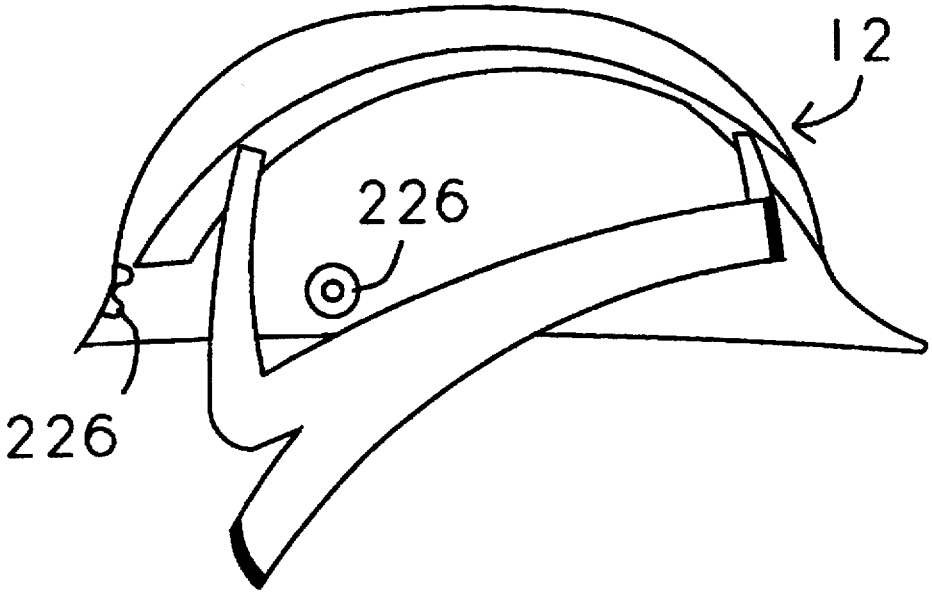
FIG. 7 is a cross-sectional side view of the hard hat of FIG. 1 showing the retaining means used to retain the drape of FIG. 4.

Similarly, referring to FIG. 7 an alternative embodiment of the hard hat 12, in which a retaining means 226 comprised of a plurality of snap fasteners 226 is shown. The snaps 226 would be used with the attachment means 222 of FIG. 4, and would be of the complementary type of snap, i.e., if the snaps 224 were male snaps, then the snap fasteners 226 would be female snaps.

Figure 8:
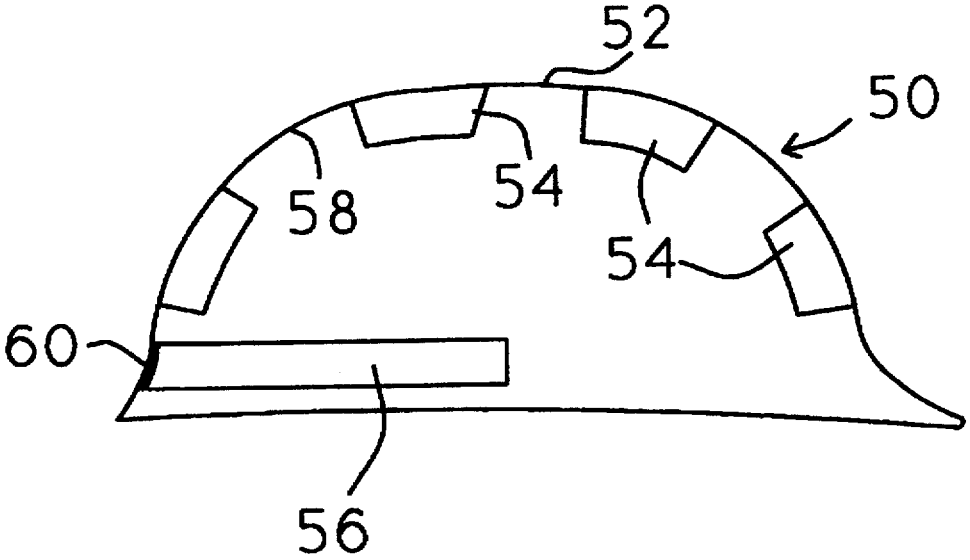
FIG. 8 is a cross-sectional side view of an alternative protective hat of the type which includes foam padding to separate the wear's head from the hard wall of the hat illustrating how the retaining means used to retain the drape of FIG. 2 would be attached.

Referring now to FIG. 8, a sports type helmet 50 of the type which has a hard outer shell 52 which is spaced from the wearer's head by foam pads 54, is shown. Again, retaining means 56 is attached to the inner wall 58 of the helmet 50, and the retaining means 56 would be spaced from the wearer's head by the thickness of the pads 54, which exceeds the thickness of the retaining means 56, as illustrated at 60.

As will be understood by those skilled in the art, the internal construction of various helmets and hard hats of the type described herein varies considerably. Consequently, the present invention constitutes a great improvement over much of the prior art described above in that it is readily adaptable for use in different hard hats and helmets without requiring a specifically customized version. In addition, and with particular reference to the use of "hook and loop" fasteners, which are commercially available both with and without paper-backed adhesive backing, it is possible to create a retrofit kit which includes at least one drape 10, preferably having one type of "hook and loop" fastener attachment means 22 already stitched (in the case of a fabric) or bonded (in the case of a plastic or other non-woven material) thereto, and an adhesive backed strip of the complementary type of "hook and loop" fastener for use as the retaining means 26, which can be used to retrofit an existing hard hat 12 or helmet of the type described herein.

I claim:

1. An article of protective headgear comprising:

(a) a protective hat consisting of two components, the first component being a hard shell, said hard shell being formed of a solid material, said hard shell having an inner wall and an outer wall, said outer wall being the outermost portion of said protective hat;

(b) the second component of said protective hat being an adjustable internal structure attached to said inner wall, said adjustable internal structure being adapted to adjust to and retain the head of the wearer and to space the back of the head of the wearer away from said inner wall;

(c) a retaining means attached to said inner wall, said retaining means being separate from and displaced from said internal structure and being completely within said hat; and (d) a drape comprised of a cloth material having an attachment means affixed to an edge thereof, said attachment means being selected to be selectively attached to said retaining means, whereby said drape may be selectively attached to said protective hat, and whereby said attachment means remains separate and displaced from said internal structure.

2. The article of protective headgear of claim 1 in which said internal structure comprises an adjustable web which can be fitted to the head of a wearer, said adjustable web being attached to support webbing within said hat, said adjustable web being spaced from the inner wall of the rear of said hat, whereby said retaining means is spaced from said adjustable web.

3. The article of protective headgear of claim 2 in which said attachment means is comprised of an elongated strip of hook and loop material, and said retaining means is comprised of an elongated strip of a complementary piece of hook and loop material.

4. The article of protective headgear of claim 2 in which said attachment means is comprised of a plurality of strips of hook and loop material, and said retaining means is comprised of a plurality of complementary strips of hook and loop material.

5. The article of protective headgear of claim 2 in which said attachment means is comprised of a plurality of snaps, and said retaining means is comprised of a plurality of complementary snap retainers.

6. The article of protective headgear of claim 1 in which said adjustable internal structure comprises at least one pad which is attached to the inner wall of said hat, said at least one pad having a thickness which is greater than the combined thickness of said drape, said attachment means, and said retaining means, whereby the thickness of said at least one pad spaces the rear of the hat away from head of a wearer.

7. The article of protective headgear of claim 6 in which said attachment means is comprised of an elongated strip of hook and loop material, and said retaining means is comprised of an elongated strip of a complementary piece of hook and loop material.

8. The article of protective headgear of claim 6 in which said attachment means is comprised of a plurality of strips of hook and loop material, and said retaining means is comprised of a plurality of complementary strips of hook and loop material.

9. The article of protective headgear of claim 6 in which said attachment means is comprised of a plurality of snaps, and said retaining means is comprised of a plurality of complementary snap retainers.

* * * * *